United States Patent [19]

Sprunck

[11] 4,043,541

[45] Aug. 23, 1977

[54] BLAST FURNACE TUYERE

[76] Inventor: Emile Sprunck, 57250 Moyeuvre Grande, France

[21] Appl. No.: 709,117

[22] Filed: July 27, 1976

[30] Foreign Application Priority Data

Aug. 13, 1975 France ..... 75.25195

[51] Int. Cl.[2] ..... C21B 7/16

[52] U.S. Cl. ..... 266/268; 266/186

[58] Field of Search ..... 266/47, 182, 187–189, 266/220–222, 265, 267, 268, 270; 110/182.5; 122/6.6; 75/42, 60

[56] References Cited

U.S. PATENT DOCUMENTS

| | | | |
|---|---|---|---|
| 936,781 | 10/1909 | Kemp | 266/187 |
| 1,073,463 | 9/1913 | Banes | 266/182 |
| 1,393,749 | 10/1921 | Carstens | 266/188 |
| 3,823,012 | 7/1974 | Johnstone et al. | 266/221 |

*Primary Examiner*—Gerald A. Dost

*Attorney, Agent, or Firm*—Lewis H. Eslinger

[57] ABSTRACT

Blast furnace tuyere comprising three separate injection chambers, a first axial chamber for injecting hot blast, a second narrow annular chamber concentric therewith for injecting fuel oil and a third annular chamber concentric with the other two for injecting oxygen mixed with cold air. This tuyere dispenses with a water cooling circuit.

3 Claims, 3 Drawing Figures

BLAST FURNACE TUYERE

The present invention relates to tuyeres for blowing air and auxiliary reducing combustibles into a blast furnace.

The present technique involves injecting air, taken to high temperature, so-called hot blast, enriched with oxygen, in conjunction with an injection of hydrocarbon. This mixture, which is already burning in the tuyere, takes said tuyere to destructive temperatures, particularly for its nose exposed to the heat and radiation of the blast furnace and one must resort to a cooling by complex water circuits which, moreover, tend to be covered with deposits of the salts dissolved in the water.

Furthermore, the enrichment of the air with oxygen is limited since, above 20%, the oxygen taken to high temperature attacks and destroys the refractory coatings of the Cowper stoves.

It is an object of the invention to remedy these multiple drawbacks and to allow injections of oxygen without limitation whilst having no need for water cooling.

To this end, the invention relates to a blast furnace tuyere comprising three separate injection chambers each opening into the nose of the tuyere, a first chamber for the hot blast, a second chamber for the combustible and a third chamber for the auxiliary supporter of combustion, the combustible injecting chamber being located between the other two chambers.

The invention will be more readily understood on reading the following description with reference to the accompanying drawings, in which.

Figure 2:
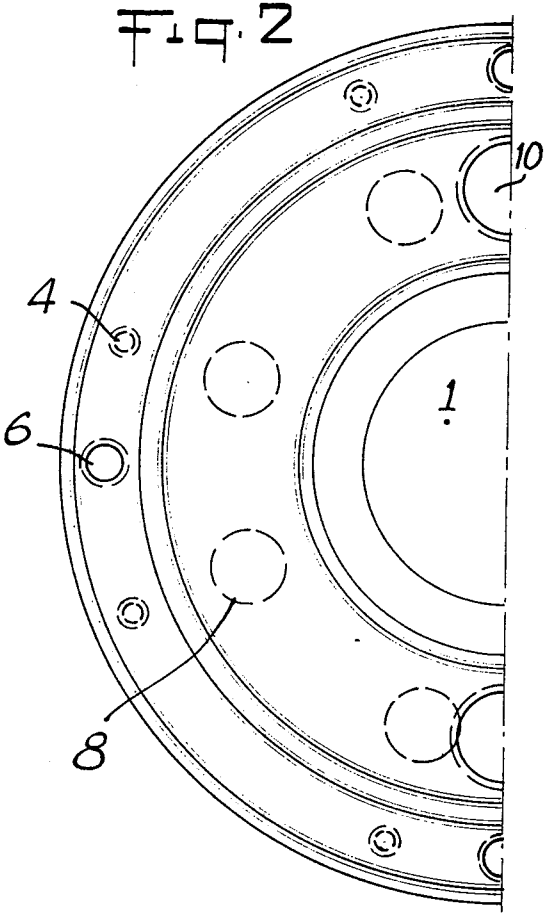
FIG. 2 is an end view in the direction of arrow F of FIG. 1.
Figure 1:
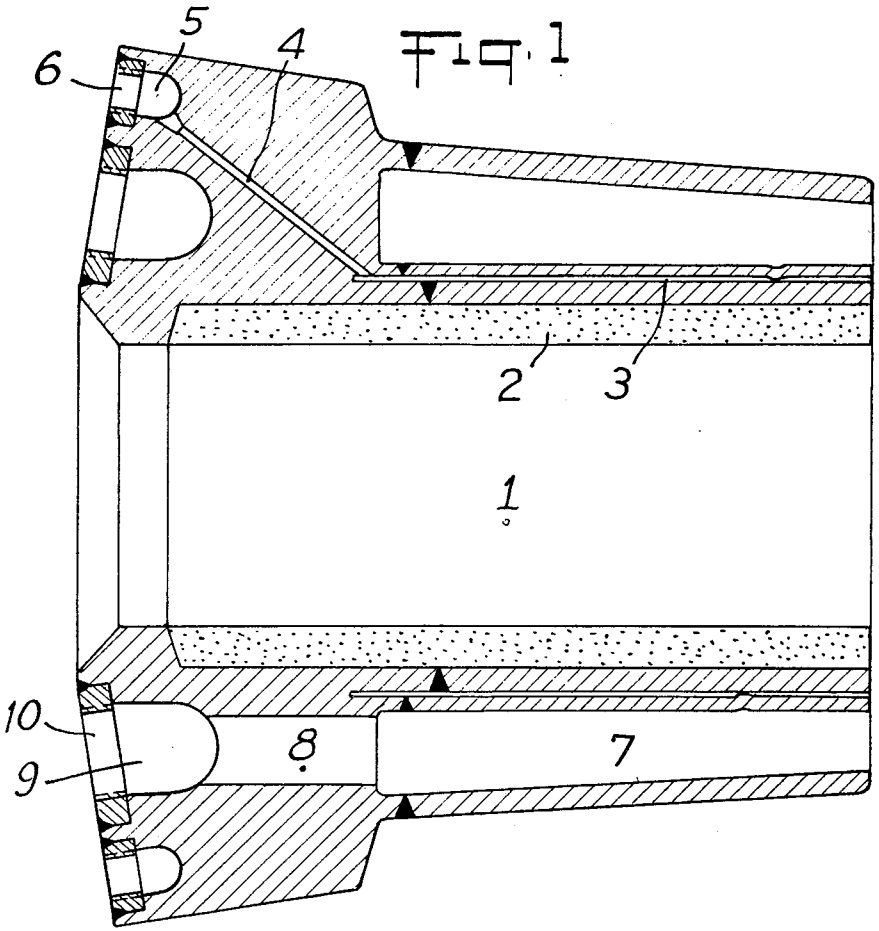
FIG. 1 is an axial section through a tuyere according to the invention.

Referring now to the drawings, FIGS. 1 and 2 show a tuyere comprising a central conduit 1 forming chamber for injecting the hot blast, the inside of said conduit possibly being lined with a refractory coating 2.

The chamber 1 is concentrically surrounded by a narrow annular chamber 3, of the order of a millimeter, which serves as reducer combustible injection chamber, for example fuel oil, and which opens out into the nose of the tuyere. This chamber 3 is supplied through conduits 4 connecting it to an annular supply chamber 5 receiving the fuel oil or any other fuel through orifices 6 for connection to a supply circuit.

The annular chamber 3 is itself surrounded by a concentric annular chamber 7 for injecting auxiliary supporter of combustion, such as an air-oxygen mixture and which also opens out into the nose of the tuyere. This chamber 7 communicates via conduits 8 with an annular supply chamber 9 provided with an orifice 10 for connection to a supply circuit.

The tuyere according to the invention allows the injection of any quantity of oxygen since said latter is sent cold, no longer being mixed with the hot blast but simply with cold air. Cooling is no longer necessary. In fact, the fuel oil in the annular injection chamber serves as cooling agent and particularly as the fuel oil is injected and atomised through the nose of the tuyere, a combustion zone is formed in front of said nose with a mist of carbon particles, which protect the nose of the tuyere from the radiation of heat from the matter in the process of melting inside the furnace.

Figure 3:
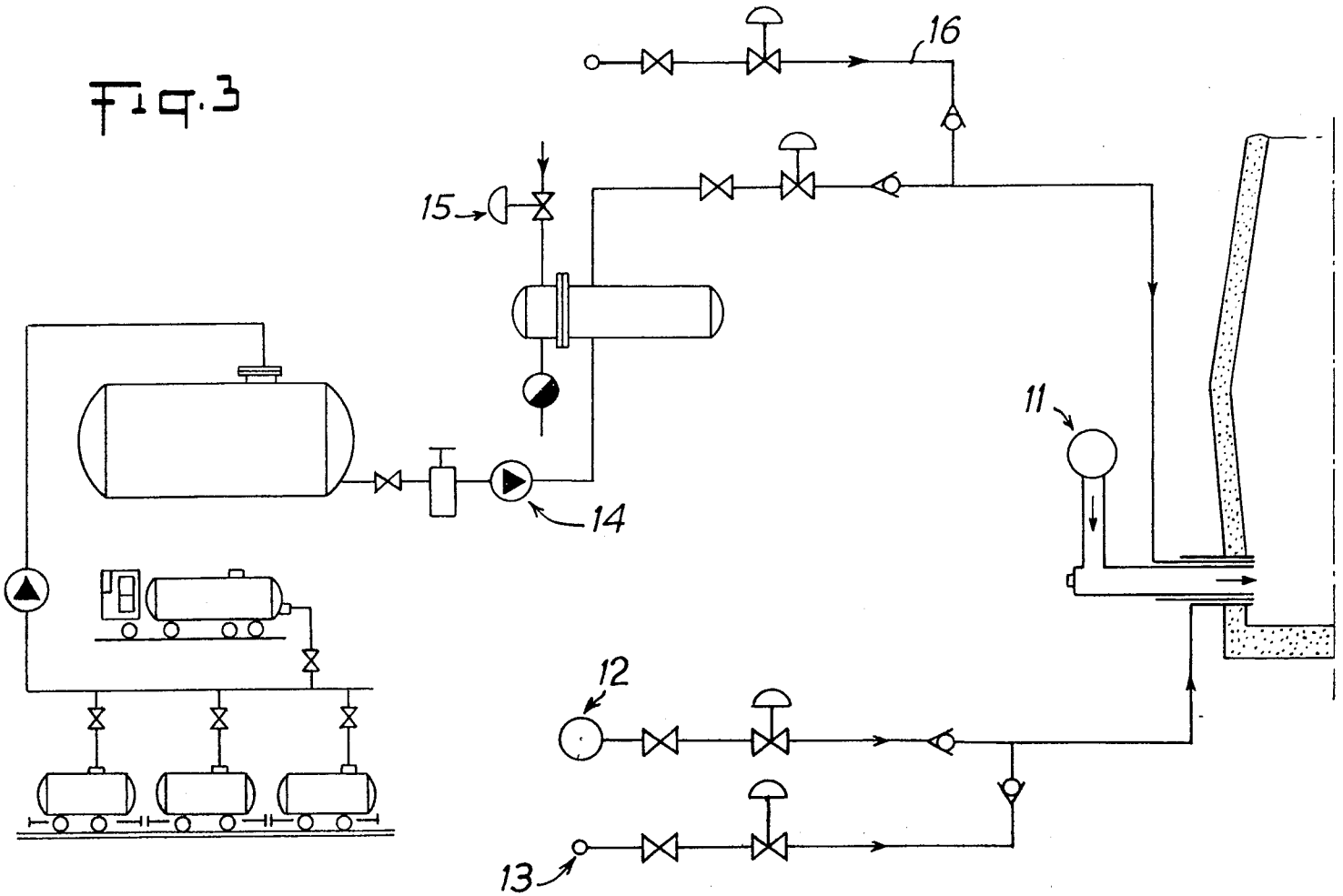
FIG. 3 is an example of a supply circuit of the tuyere according to the invention.

With such a tuyere, the supply may be very easily regulated by means of a circuit, as shown in FIG. 3, wherein 11 represents the hot blast supply for conduit 1, 12 a cold-air supply to which is connected an oxygen supply 13 for chamber 7, and finally 14 a fuel oil supply with reheating 15 by vapour for chamber 3, with, in parallel, a supply 16 of vapour alone which serves, upon prolonged stoppage of fuel oil supply, to purge the chamber 3 and supply conduits 4 and 5 or to bring said latter to the suitable temperature for reinjecting of fuel oil.

It is obvious that the fuel oil can be replaced by other reducing agents and, in particular, by fuel gas.

What is claimed is:

1. A blast furnace tuyere comprising a tuyere casing having an injection nose for insertion in a furnace and three separate injection chambers formed therein, said injection chambers each having open injection end portions located in the nose of the tuyere casing, said three injection chambers comprising a first chamber for hot blast to be supplied to the furnace, a second chamber for supplying combustible fuel to the furnace and a third chamber for supplying an auxiliary supporter of combustion to the furnace, said three chambers being isolated from each other in the casing with the combustible fuel injecting chamber being located between the other two chambers whereby the combustible fuel serves as a cooling agent for the nose of the tuyere.

2. A tuyere as claimed in claim 1, wherein the hot blast injecting chamber is a central conduit surrounded by two concentric annular chambers, the chamber for injecting reducing combustible being narrow.

3. A tuyere as claimed in claim 1, wherein the hot blast injecting chamber is coated with refractory material.

* * * * *